US007644849B2

(12) United States Patent
Tsai et al.

(10) Patent No.: US 7,644,849 B2
(45) Date of Patent: Jan. 12, 2010

(54) EFFORT-SAVING STAPLER

(75) Inventors: Eric Tsai, Tali (TW); Pi-Yi Chang, Tali (TW); Chih-Wei Hu, Taichung (TW)

(73) Assignee: Apex Mfg. Co., Ltd., Taichung Hsien (TW)

( * ) Notice: Subject to any disclaimer, the term of this patent is extended or adjusted under 35 U.S.C. 154(b) by 0 days.

(21) Appl. No.: 11/686,798

(22) Filed: Mar. 15, 2007

(65) Prior Publication Data

US 2008/0223902 A1 Sep. 18, 2008

(51) Int. Cl.
*B25C 5/11* (2006.01)

(52) U.S. Cl. ..... 227/132; 227/129; 227/146

(58) Field of Classification Search ..... 227/132, 227/134

See application file for complete search history.

(56) References Cited

U.S. PATENT DOCUMENTS 1,105,191 A * 7/1914 Murphy et al. ..... 140/154
1,437,228 A * 11/1922 Craig ..... 227/155
1,457,446 A * 6/1923 Michener ..... 227/132
1,757,812 A * 5/1930 Polzer ..... 227/132
2,028,350 A * 1/1936 Polzer ..... 227/134
2,137,642 A * 11/1938 Cavanagh ..... 227/132
2,285,512 A * 6/1942 Harley ..... 227/132
2,326,540 A * 8/1943 Krantz ..... 173/31
2,346,884 A * 4/1944 Wheeler ..... 227/116
2,412,620 A * 12/1946 Kipp ..... 227/132
2,437,039 A * 3/1948 Peterson et al. ..... 173/202
2,493,640 A * 1/1950 Peterson ..... 227/132
2,603,782 A * 7/1952 Spencer ..... 227/132
2,617,097 A * 11/1952 Spencer ..... 227/132
2,659,083 A * 11/1953 Boroughs ..... 173/202
2,671,215 A * 3/1954 Abrams ..... 227/132
2,710,964 A * 6/1955 Spencer ..... 227/132
2,769,174 A * 11/1956 Libert ..... 227/132
2,884,636 A * 5/1959 Abrams ..... 227/146
3,131,397 A * 5/1964 Miller ..... 227/132
3,199,185 A * 8/1965 Lash et al. ..... 29/434
3,229,882 A * 1/1966 Abrams ..... 227/132
3,275,212 A * 9/1966 Johnson ..... 227/132
3,491,578 A * 1/1970 Biermann ..... 29/243.521
3,610,505 A * 10/1971 Males et al. ..... 227/127
3,753,524 A * 8/1973 Heyward ..... 227/132

(Continued)

OTHER PUBLICATIONS

Taiwanese Patent Publication No. 576290, Feb. 11, 2004, 6 pages.

*Primary Examiner*—Rinaldi I. Rada
*Assistant Examiner*—Lindsay Low
(74) *Attorney, Agent, or Firm*—Alan Kamrath; Kamrath & Associates PA

(57) ABSTRACT

An effort-saving stapler includes a shell, a magazine, a hammer, an elastic element, a block, a trigger and an extensive element. The magazine is disposed in the shell for supporting and feeding nails. The hammer is disposed in the shell for hammering the nails, one at a time. The elastic element is disposed in the shell for biasing the hammer. The block is disposed in the shell. The trigger is movably and pivotally connected to the shell and engaged with the block at an engagement point. The extensive element includes a first end connected to the hammer and a second end telescopically connected to the trigger. When the trigger is operated, the hammer is lifted by the extensive element and the engagement point is moved towards the hammer.

20 Claims, 8 Drawing Sheets

U.S. PATENT DOCUMENTS 3,913,817 A * 10/1975 Barrett et al. ..... 227/126
4,119,258 A * 10/1978 Ewig, Jr. ..... 227/132
4,126,260 A * 11/1978 Mickelsson ..... 227/132
4,225,075 A * 9/1980 Chi ..... 227/119
4,358,043 A * 11/1982 Chi ..... 227/155
4,450,998 A * 5/1984 Ruskin ..... 227/8
4,596,350 A * 6/1986 Smith et al. ..... 227/19
4,699,307 A * 10/1987 Kozyrski et al. ..... 227/132
5,131,580 A * 7/1992 Allman ..... 227/132
5,165,587 A * 11/1992 Marks ..... 227/132
5,335,839 A * 8/1994 Fealey ..... 227/132
5,758,813 A * 6/1998 Kikuchi et al. ..... 227/155
5,810,848 A * 9/1998 Hayhurst ..... 606/144
5,937,951 A * 8/1999 Izuchukwu et al. ..... 227/176.1
5,979,736 A * 11/1999 Edeholt ..... 227/132
2002/0108996 A1* 8/2002 Cornett et al. ..... 227/132
2004/0084504 A1* 5/2004 Shor ..... 227/132
2004/0238592 A1* 12/2004 Shor ..... 227/132
2005/0116008 A1* 6/2005 Thornton et al. ..... 227/176.1
2005/0139631 A1* 6/2005 Marks ..... 227/134
2007/0039994 A1* 2/2007 Pelletier et al. ..... 227/132
2007/0145094 A1* 6/2007 Chou ..... 227/132
2007/0257080 A1* 11/2007 Kamins et al. ..... 227/132
2007/0267460 A1* 11/2007 Popowich ..... 227/132
2008/0223897 A1* 9/2008 Shor ..... 227/8
2008/0290133 A1* 11/2008 Shor ..... 227/132

* cited by examiner

EFFORT-SAVING STAPLER

BACKGROUND OF INVENTION

1. Field of Invention

The present invention relates to an effort-saving stapler.

2. Related Prior Art

As disclosed in Taiwanese Patent Publication No. 576290, a conventional stapler 10 includes a shell 20 and a mechanism 30. The shell 20 includes two halves. The mechanism 30 includes a hammer 31, a leaf spring 32 and a trigger 33. The hammer 31 is movably disposed in the shell 20. The leaf spring 32 is disposed in the shell 20. The leaf spring 32 is connected to the hammer 31. The trigger 33 is connected to the shell 20 by a pin 34. A tongue 35 is connected to the trigger 33 by a pin 37. The tongue 35 is biased by a torque spring 36. The tongue 35 is normally inserted in an aperture 311 defined in the hammer 31. To staple, a user pulls the trigger 33. The tongue 35 lifts the hammer 31 that loads the leaf spring 32. Having fully pulled the trigger 33, the user causes the tongue 35 to leave the hammer 31. The leaf spring 32 drives the hammer 31 down to hit the nail. The use, however, has to pull the trigger 33 harder and harder. The user has to pull the trigger 33 hard so that he soon feels tired.

The present invention is therefore intended to obviate or at least alleviate the problems encountered in the prior art.

SUMMARY OF INVENTION

According to the present invention, an effort-saving stapler includes a shell, a magazine, a hammer, an elastic element, a block, a trigger and an extensive element. The magazine is disposed in the shell for supporting and feeding staples. The hammer is disposed in the shell for hammering the staples, one at a time. The elastic element is disposed in the shell for biasing the hammer. The block is disposed in the shell. The trigger is movably and pivotally connected to the shell and engaged with the block at an engagement point. The extensive element includes a first end connected to the hammer and a second end telescopically connected to the trigger. When the trigger is operated, the hammer is lifted by the extensive element, and the engagement point is moved towards the hammer.

An advantage of the effort-saving stapler is to provide an effort-saving operation, since a user does not have to pull the trigger hard.

Another advantage of the effort-saving stapler is to provide an efficient operation, since the user can use the effort-saving stapler for a long time without having to rest.

Other advantages and features of the present invention will become apparent from the following description referring to the drawings.

BRIEF DESCRIPTION OF DRAWINGS

The present invention will be described via detailed illustration of the preferred embodiment referring to the drawings.

DETAILED DESCRIPTION OF PREFERRED EMBODIMENT

Figure 1:
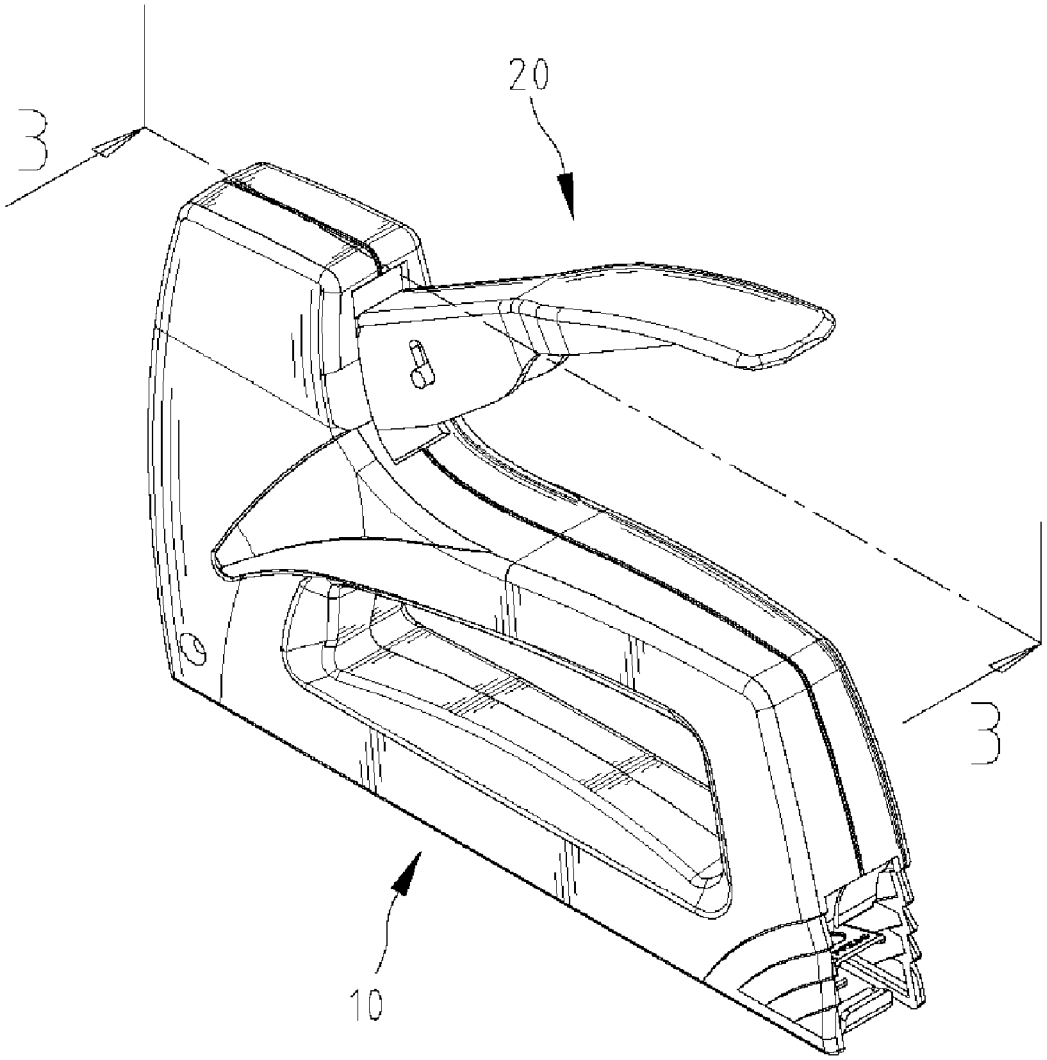
FIG. 1 is a perspective view of an effort-saving stapler according to the preferred embodiment of the present invention.
Figure 2:
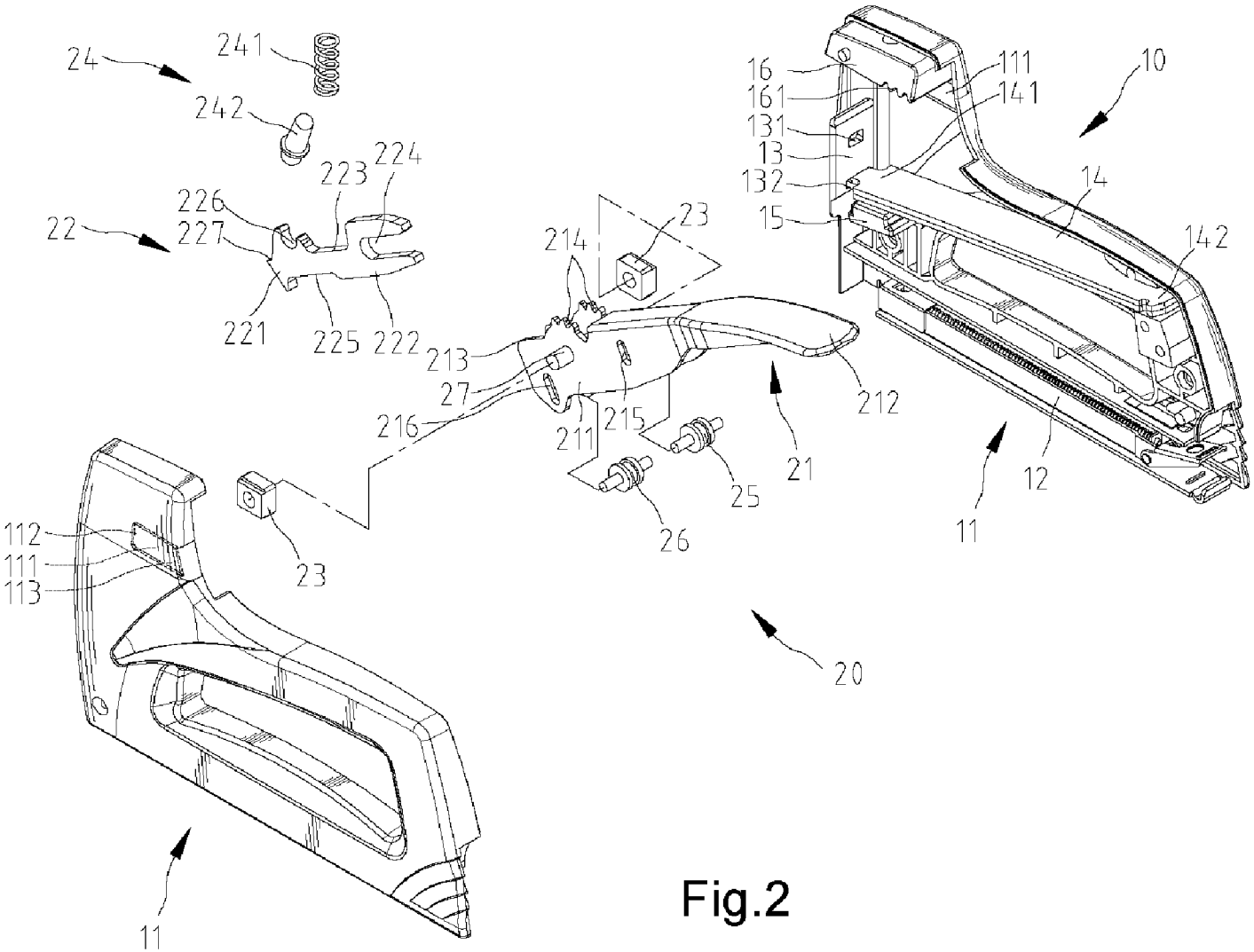
FIG. 2 is an exploded view of the effort-saving stapler shown in FIG. 1.
Figure 3:
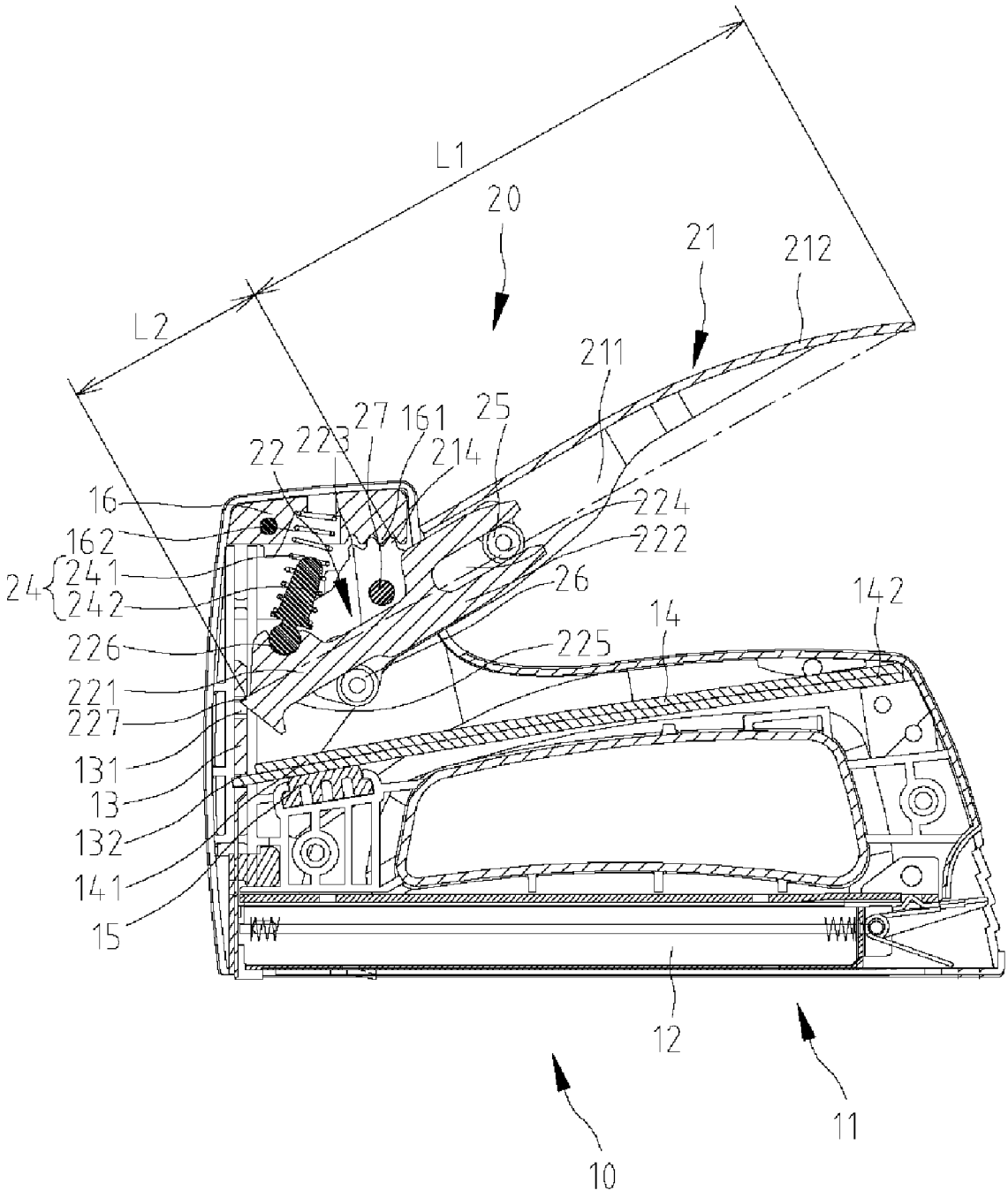
FIG. 3 is a cross-sectional view of the effort-saving stapler taken along a line 3-3 shown in FIG. 1.

Referring to FIGS. 1 through 3, an effort-saving stapler includes a shell 10, a hammering device and an effort-saving triggering device 20 according to the preferred embodiment of the present invention.

The shell 10 consists of two halves 11 each including, on an internal side thereof, a groove 111 with a first closed end 112 and a second closed end 113.

The hammering device includes a magazine 12, a hammer 13, an elastic element 14 and a buffer 15. Staples are carried and fed by the magazine 12 disposed in the shell 10 and hammered, one at a time, by the hammer 13 movably disposed in the shell 10. The hammer 13 is a plate defining a first aperture 131 and a second aperture 132 below the first aperture 131. The elastic element 14 is preferably a leaf spring with a first end 141 inserted in the second aperture 132 of the hammer 13 and a second end 142 secured to a portion of the shell 10. Thus, the hammer 13 is biased by the elastic element 14. The elastic element 14 is buffered by the buffer 15 disposed in the shell 10.

The triggering device 20 includes a block 16, a trigger 21, two bearings 23, an extensive element 22, three pins 25, 26 and 27 and an elastic unit 24.

The block 16 includes teeth 161 formed on the bottom thereof and a recess 162 defined in the bottom thereof.

The trigger 21 includes two walls 211, a lever 212 formed on the walls 211 and a space 213 defined between the walls 211. Each of the walls 211 includes teeth 214 formed on an arched upper edge thereof and two slots 215 and 216 defined therein.

Two ends of the pin 27 are inserted in the bearings 23 movably disposed in the grooves 111. Thus, the trigger 21 is movably and pivotally connected to the shell 10.

The extensive element 22 includes a tip 227 formed at a first end 221 thereof, a slit 224 defined in a second end 222 thereof, a first recess 223 defined in an upper edge thereof, a second recess 226 defined in the upper edge thereof and a third recess 225 defined in a lower edge thereof.

The extensive element 22 is disposed between the walls 211. The pin 25 is disposed in the slit 224, with two ends thereof inserted in the slots 215. The pin 26 is disposed in the third recess 225 of the extensive element 22, with two ends thereof inserted in the slots 216. The pin 27 is disposed in the first recess 223 of the extensive element 22. Thus, the extensive element 22 is pinched between the pins 26 and 27. The tip 227 is inserted in the first aperture 131 of the hammer 13.

The elastic unit 24 includes an elastic element 241 and a pusher 242 connected to the elastic element 241. The elastic element 241 is preferably a helical spring. The pusher 242 is shaped like a mushroom. The elastic unit 24 is arranged between the block 16 and the extensive element 22. In detail, an end of the elastic element 241 is disposed in the recess 162 of the block 16 while an end of the pusher 242 is disposed in the second recess 226 of the extensive element 22.

Figure 4:
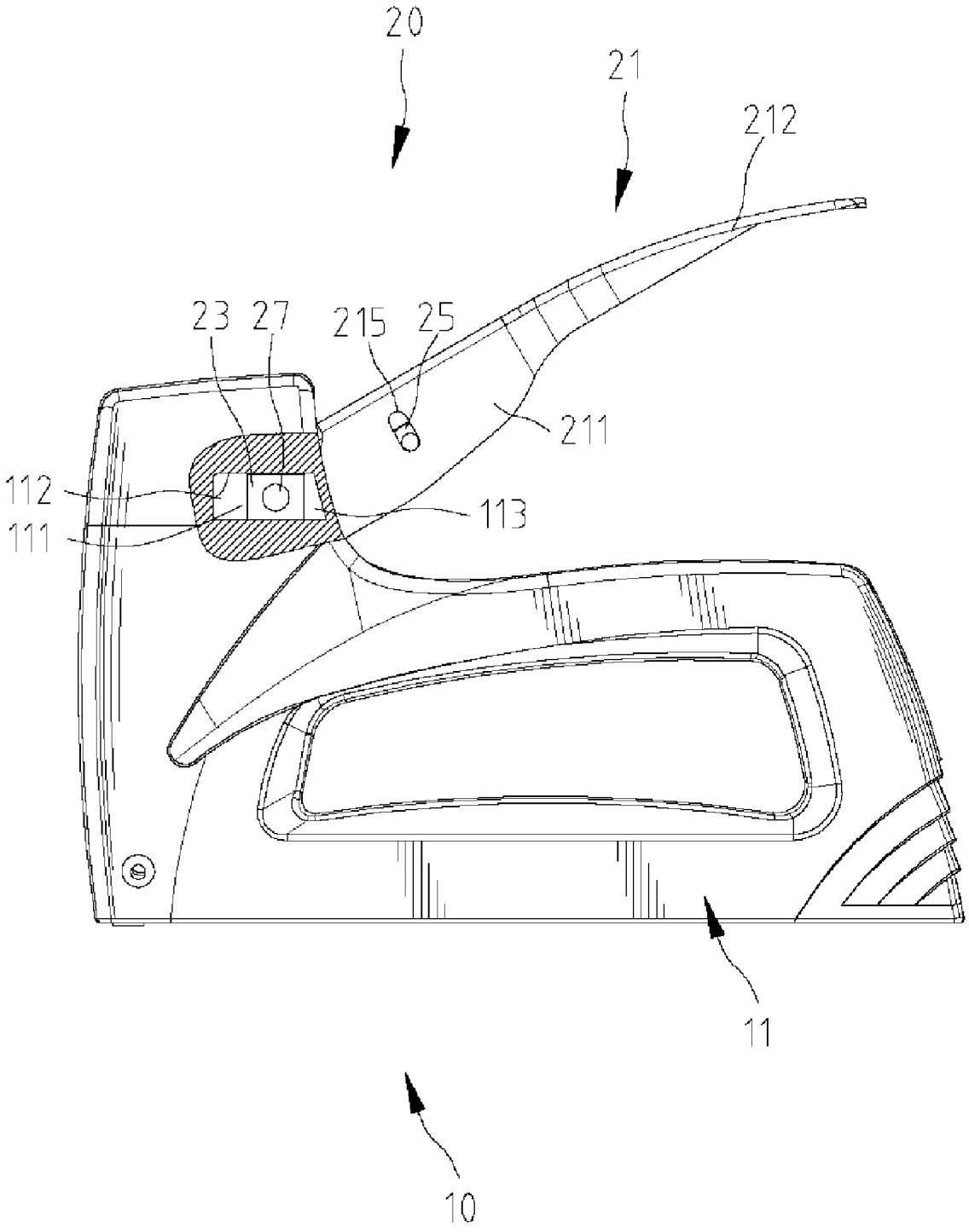
FIG. 4 is a side view of the effort-saving stapler shown in FIG. 1.

Referring to FIGS. 3 and 4, the effort-saving stapler is in its normal position where the trigger 21 is not operated while the elastic element 14 is not loaded. One of the teeth 214 furthest to the right is engaged with one of the teeth 161 furthest to the right. There is a distance L1 measured from the engagement point to the right end of the trigger 21. There is another distance L2 measured from the engagement point to the point where the tip 227 is in contact with the hammer 13. The ratio of the distance L1 to the distance L2 is small.

Figure 5:
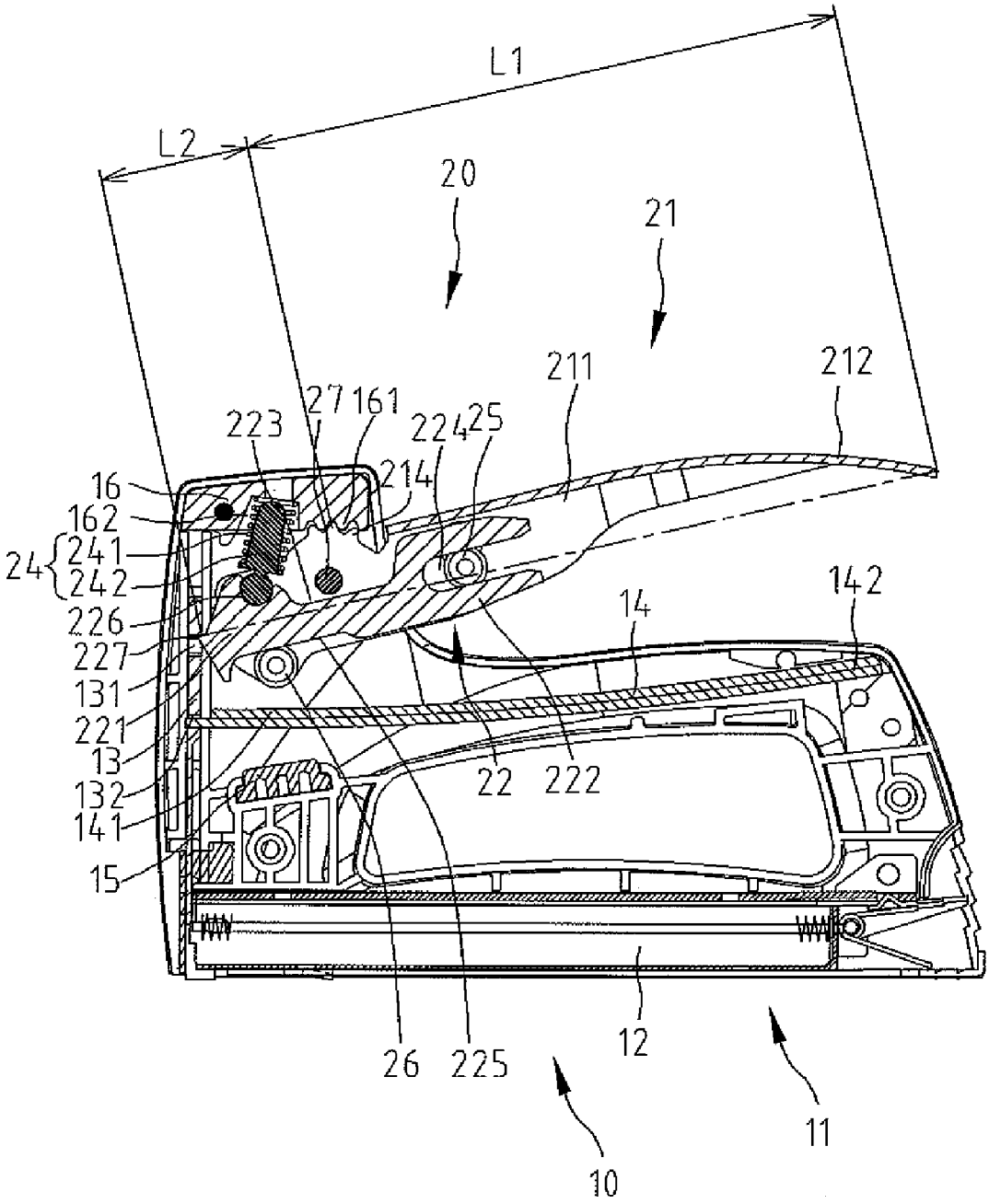
FIG. 5 is a cross-sectional view of the effort-saving stapler in another position than shown in FIG. 1.
Figure 6:
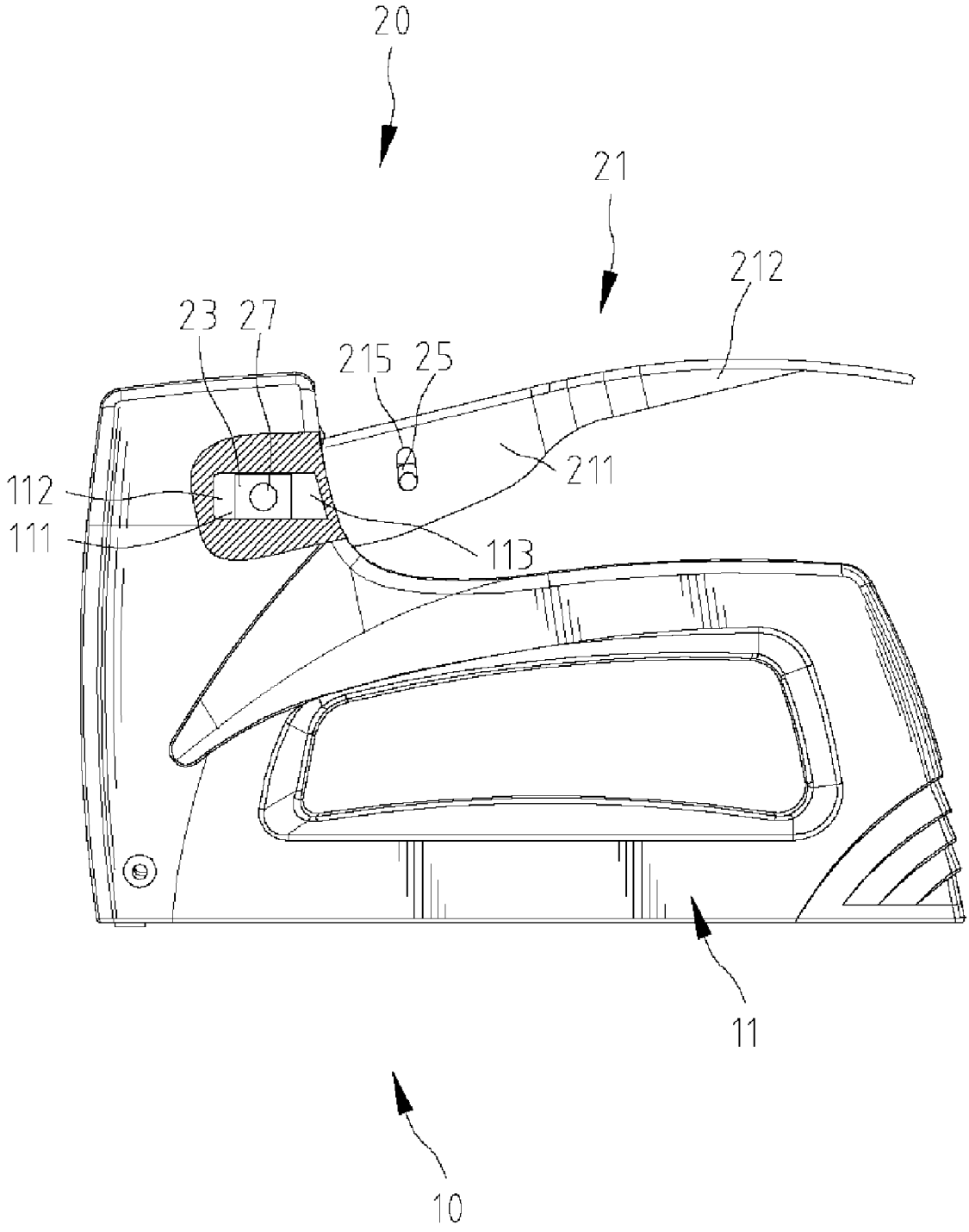
FIG. 6 is a side view of the effort-saving stapler shown in FIG. 5.

Referring to FIGS. 5 and 6, the trigger 21 is pivoted so that the elastic element 14 is loaded, i.e., the load on the elastic element 14 is increased from zero as shown in FIGS. 3 and 4. One of the teeth 214 in the middle is engaged with one of the teeth 161 in the middle. The distance L1 gets longer while the distance L2 gets shorter so that the ratio is increased. The increased load is counterbalanced by the increased ratio so that a user does not have to pull the trigger 21 much harder from the position shown in FIGS. 3 and 4 to the position shown in FIGS. 5 and 6.

Figure 7:
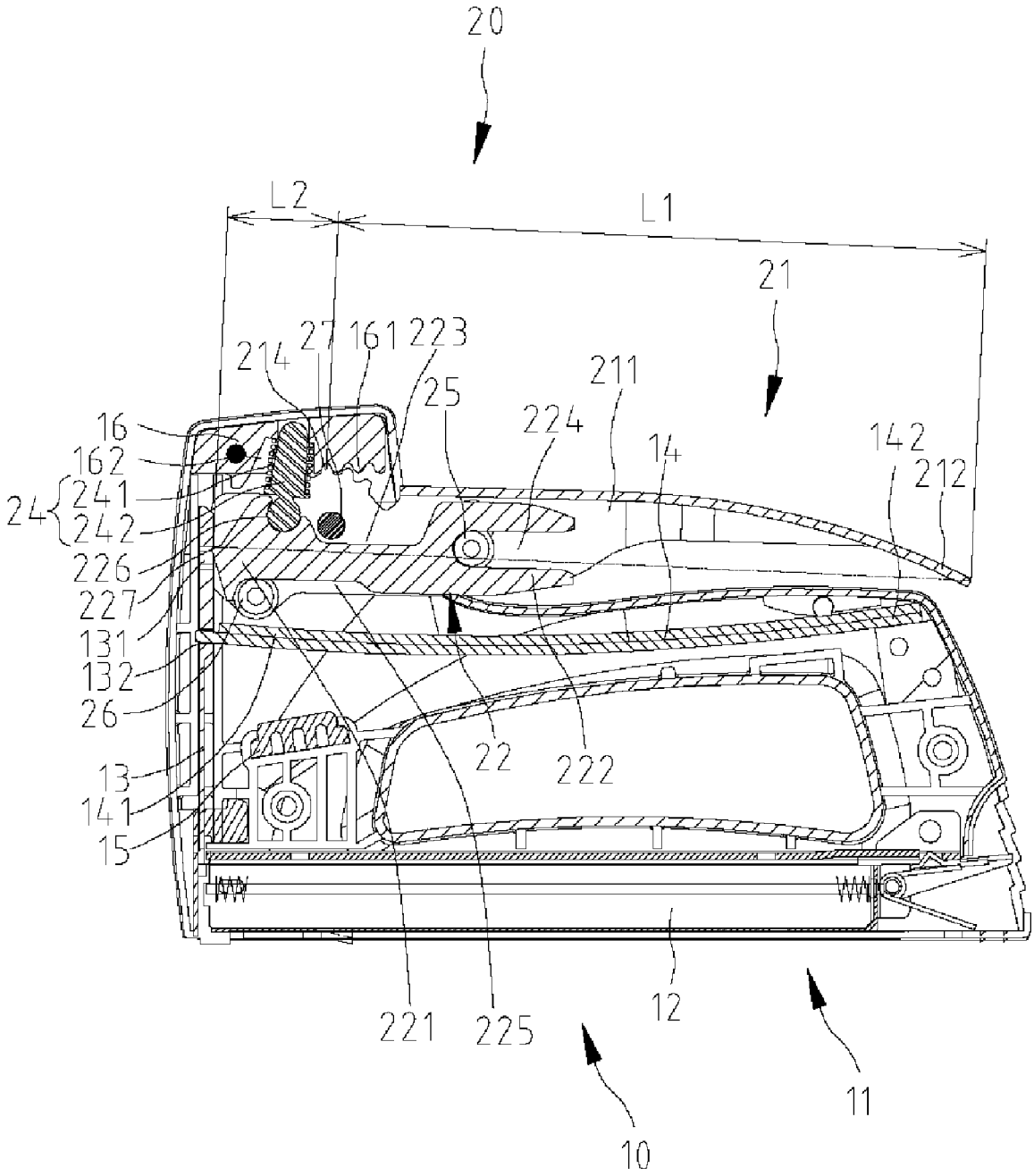
FIG. 7 is a cross-sectional view of the effort-saving stapler in another position than shown in FIG. 5.
Figure 8:
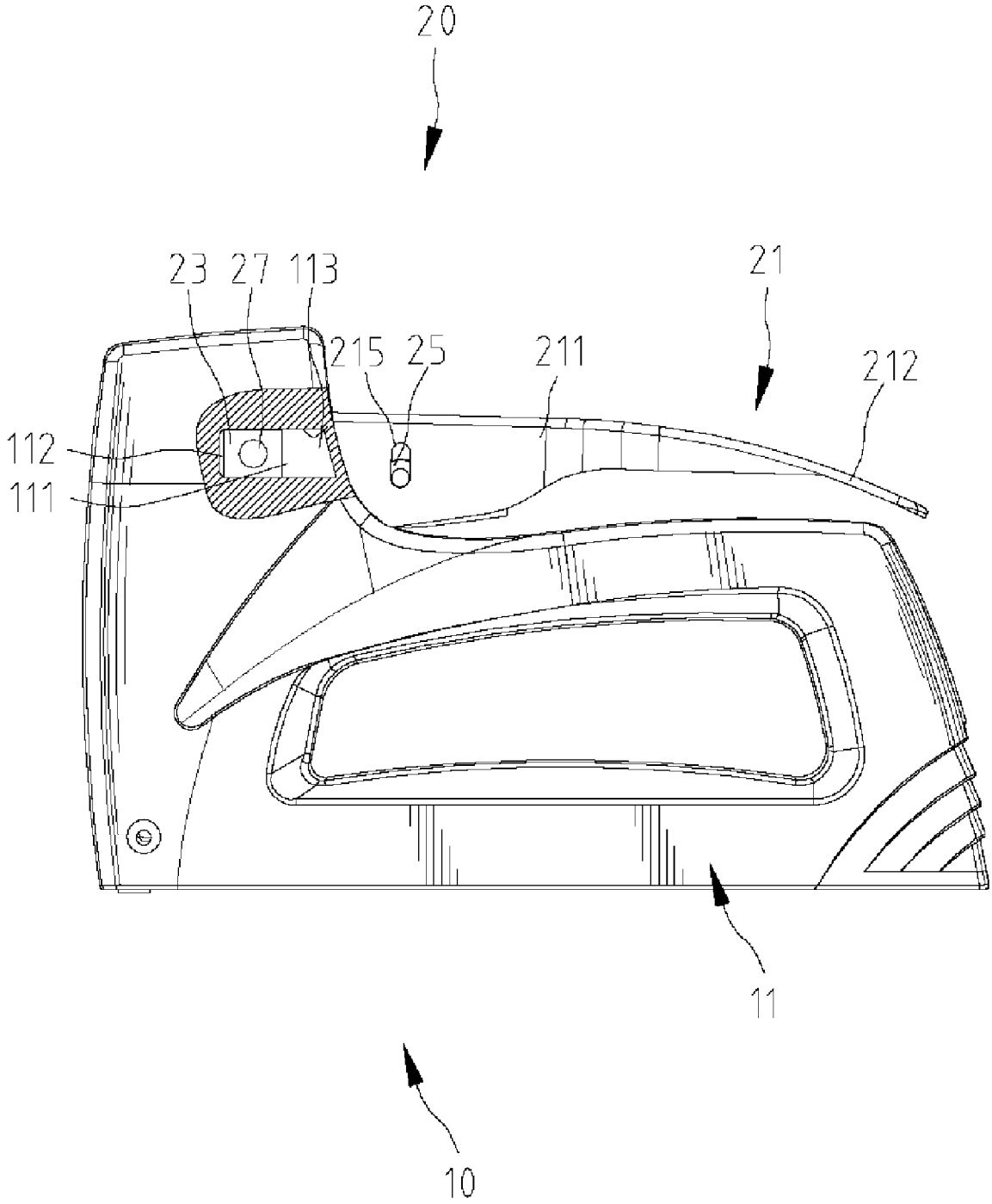
FIG. 8 is a side view of the effort-saving stapler shown in FIG. 7.

Referring to FIGS. 7 and 8, the trigger 21 is substantially fully pivoted so that the elastic element 14 is substantially fully loaded, i.e., the load on the elastic element 14 is substantially heaviest. One of the teeth 214 furthest to the left is engaged with one of the teeth 161 furthest to the left. The distance L1 is longest while the distance L2 is shortest so that the ratio is largest. The heaviest load is counterbalanced by the largest ratio so that the user does not have to pull the trigger 21 much harder from the position shown in FIGS. 5 and 6 to the position shown in FIGS. 7 and 8.

Conclusively, the increasing in the load on the elastic element 14 is counterbalanced by the increasing of the ratio during the pivoting of the trigger 21.

An advantage of the effort-saving stapler is therefore to provide an easy operation, since the user does not have to pull the trigger hard.

Another advantage of the effort-saving stapler is to provide an efficient operation, since the user can use the effort-saving stapler for a long time without having to rest.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. An effort-saving stapler comprising:

a shell;

a magazine disposed in the shell for supporting and feeding nails or staples;

a hammer disposed in the shell for hammering the nails or staples, one at a time;

an elastic element disposed in the shell for biasing the hammer;

a block disposed in the shell, wherein the block comprises teeth formed thereon;

a trigger engaged with the block at an engagement point, wherein the trigger comprises teeth of which a selective one is engaged with a selective one of the teeth of the block, with the trigger pivotally connected to the shell by a pivot pin inserted through the trigger and the shell, with the pivot pin movably disposed in the shell for movement perpendicular to the pivot pin, with the trigger moveable between a normal position and a fully pivoted position, with the pivot pin in the normal position being spaced and parallel to the pivot pin in the fully pivoted position; and an extensive element comprising a first end connected to the hammer and a second end telescopically connected to the trigger so that when the trigger is operated, the hammer is lifted by the extensive element and the engagement point is moved towards the hammer.

2. The effort-saving stapler according to claim 1 further comprising two bearings supporting the pivot pin so that the trigger can be pivoted, and wherein the bearings are movably disposed in the shell for movement relative to the shell perpendicular to the pivot pin.

3. The effort-saving stapler according to claim 2 wherein the shell comprises two grooves for receiving the bearings, with the two bearings moving inside of the two grooves perpendicular to the pivot pin.

4. The effort-saving stapler according to claim 1 wherein the trigger comprises two walls for sandwiching the extensive element, wherein each wall of the trigger includes the teeth formed on an arched upper edge thereof.

5. The effort-saving stapler according to claim 4 further comprising an element pin inserted through the two walls, wherein the extensive element defines a slit for receiving the element pin.

6. The effort-saving stapler according to claim 5 wherein each of the two walls of the trigger comprises a slot for receiving the element pin.

7. The effort-saving stapler according to claim 5 further comprising a pinching pin, with the pivot pin and the pinching pin pinching the extensive element.

8. The effort-saving stapler according to claim 7 wherein the extensive element comprises two recesses for receiving the pivot and pinching pins for pinching the extensive element.

9. The effort-saving stapler according to claim 7 wherein each of the two walls of the trigger comprises a slot for receiving the pinching pin for pinching the extensive element.

10. The effort-saving stapler according to claim 1 comprising an elastic unit arranged between the block and the extensive element.

11. The effort-saving stapler according to claim 10 wherein the elastic unit comprises an elastic element and a pusher connected to the elastic element.

12. The effort-saving stapler according to claim 11 wherein the block comprises a recess for receiving the elastic element.

13. The effort-saving stapler according to claim 11 wherein the elastic element is a helical spring.

14. The effort-saving stapler according to claim 11 wherein the elastic element comprises a recess for receiving the pusher.

15. The effort-saving stapler according to claim 11 wherein the pusher is shaped like a mushroom.

16. The effort-saving stapler according to claim 1 wherein the extensive element comprises a tip at the first end, and the hammer comprises an aperture for receiving the tip of the extensive element.

17. The effort-saving stapler according to claim 1 wherein the hammer comprises an aperture for receiving an end of the elastic element.

18. The effort-saving stapler according to claim 1 wherein the elastic element is a leaf spring.

19. The effort-saving stapler according to claim 1 wherein a distance L2 is defined from the engagement point to where the trigger is engaged with the hammer and a distance L1 is defined from the engagement point to an opposite end of the trigger, wherein the distances L1 and L2 are changeable via the teeth of the trigger pivoting relative to the teeth of the block, and while the distance L2 gets longer, the distance L1 gets shorter as to increase a ratio of the distance L2 to the distance L1 for an effort-saving operation.

20. The effort-saving stapler according to the claim 1 wherein the extensive element is intermediate the block and the elastic element.

* * * * *